US006286786B1

(12) United States Patent
Le Gette et al.

(10) Patent No.: US 6,286,786 B1
(45) Date of Patent: Sep. 11, 2001

(54) REMOTELY CONTROLLED AIRCRAFT

(75) Inventors: Brian Edward Le Gette, Severna Park; Tai Hoon Kim Matlin, Towson, both of MD (US); James Ashley Waring, Vernon Hill, IL (US)

(73) Assignee: Gray Matter Holdings, LLC, Baltimore, MD (US)

( * ) Notice: Subject to any disclaimer, the term of this patent is extended or adjusted under 35 U.S.C. 154(b) by 0 days.

(21) Appl. No.: 09/045,994

(22) Filed: Mar. 23, 1998

(51) Int. Cl.[7] ..... B64C 31/06

(52) U.S. Cl. ..... 244/153 R; 244/155 R; 244/155 A

(58) Field of Search ..... 244/152, 153 R, 244/900, 901, 902, 155 R, 154, 155 A, 3

(56) References Cited

U.S. PATENT DOCUMENTS

| | | | | |
|---|---|---|---|---|
| 1,925,427 | | 9/1933 | Wurtzer | 48/50 |
| 1,927,835 | | 9/1933 | Kellogg | 244/22 |
| 2,364,006 | | 11/1944 | Smith | 244/219 |
| 2,493,704 | | 1/1950 | Tomczyk et al. | 244/154 |
| 2,548,748 | | 4/1951 | Stephan | 244/154 |
| 2,649,262 | * | 8/1953 | Fahrney . | |
| 2,669,403 | | 2/1954 | McKay nee Milligan | 244/155 |
| 2,734,697 | * | 2/1956 | Brow | 244/3 |
| 2,801,063 | | 7/1957 | O'Gorman | 244/154 |
| 2,827,252 | | 3/1958 | Pohl | 244/154 |
| 2,833,497 | | 5/1958 | Young | 244/155 |
| 3,001,747 | | 9/1961 | Hockett | 244/154 |
| 3,076,626 | | 2/1963 | Andrews | 244/154 |
| 3,204,368 | | 9/1965 | Effinger, Jr. et al. | 46/78 |
| 3,306,559 | | 2/1967 | Girard | 244/90 |
| 3,366,354 | | 1/1968 | Sterba | 244/154 |
| 3,456,901 | * | 7/1969 | Wieland . | |
| 3,582,026 | | 6/1971 | Giolitto | 244/155 |
| 3,684,219 | | 8/1972 | King | 244/155 |
| 3,735,949 | * | 5/1973 | Theis | 244/155 A |
| 3,758,057 | | 9/1973 | Stratton | 244/154 |
| 3,770,230 | | 11/1973 | Johnston | 244/155 |
| 3,908,305 | | 9/1975 | Schroeder | 46/74 |
| 4,159,087 | | 6/1979 | Moomaw | 244/153 |
| 4,168,816 | | 9/1979 | Acosta | 244/154 |
| 4,180,221 | | 12/1979 | Harris | 244/13 |
| 4,194,317 | | 3/1980 | Kidd | 46/76 |
| 4,248,394 | * | 2/1981 | Klumpp . | |
| 4,261,536 | * | 4/1981 | Melcher et al. | 244/155 A |
| 4,349,169 | | 9/1982 | McAnally | 244/219 |
| 4,403,755 | | 9/1983 | Gutsche | 244/53 |
| 4,461,438 | * | 7/1984 | Pook et al. . | |
| 4,533,099 | | 8/1985 | Stewart | 244/153 |
| 4,623,108 | | 11/1986 | Musick | 244/13 |
| 4,759,736 | | 7/1988 | Carlson | 446/62 |
| 4,781,344 | | 11/1988 | Thomas | 244/154 |
| 4,884,765 | * | 12/1989 | Renecle . | |
| 5,094,638 | | 3/1992 | Kobayashi | 440/33 |
| 5,571,038 | | 11/1996 | Halling | 446/292 |
| 5,931,416 | | 8/1999 | Carpenter | 244/155 |

* cited by examiner

*Primary Examiner*—Peter M. Poon
*Assistant Examiner*—Tien Dinh
(74) *Attorney, Agent, or Firm*—Cooley Godward LLP

(57) ABSTRACT

A remotely controlled aircraft has a motor controlled by a remotely located control unit having a flight string releasibly coupled at the aircraft. The aircraft receives a signal at the aircraft activating the remote control motor. The flight string is released at the aircraft and the flight direction of the aircraft is controlled by the remote control motor based on the received signal.

20 Claims, 12 Drawing Sheets

REMOTELY CONTROLLED AIRCRAFT

BACKGROUND OF THE INVENTION

The present invention relates generally to a remotely controlled aircraft. More specifically, the present invention relates to a remotely controlled aircraft having a remote control motor in the aircraft which can release the flight string at the aircraft and/or can control the flight direction of the aircraft.

Launching known remote-control glider systems is difficult. Typically, known glider systems are launched from a bungee cord connected to the ground, an airborne powered remote control airplane, a motor powered winch, or an elevated position (e.g., a cliff). Because these launch methods require additional equipment or a specific type of geography, these known aircraft systems are not desirable.

In an attempt to allow gliders to be used in more situations and geographic locations, some known systems combine a kite configuration with a glider configuration. For example, U.S. Pat. No. 2,669,403 issued to McKay nee Milligan discloses a main kite carrying a glider and a second smaller kite that travels the flight string of the main kite to release the glider once the main kite has obtained a sufficient altitude.

U.S. Pat. No. 4,159,087 issued to Moomaw and U.S. Pat. No. 1,927,835 issued to Kellogg each disclose a kite that flies as a glider after the flight string has been released at the location of the person controlling the kite once the kite has obtained a sufficient altitude. The Moomaw system further includes a motor mechanism on the glider that rewinds the flight string into the glider once the flight string has been released. These known systems, however, once the flight string has been released at a location on the ground, allow the flight string to dangle from the glider for at least a limited period of time during which the flight string can interfere the flight of the glider.

Furthermore, known systems do not have effective and simple mechanisms for steering a remotely controlled aircraft. For example, U.S. Pat. No. 4,194,317 issued to Kidd discloses remote control servomotors that control the position of a suspended pendulum weight. The pendulum weight is in addition to a separate landing system consisting of an undercarriage system having landing wheels. The undercarriage system is separate from the pendulum weight to provide a way of landing without damaging the servomotors. This known system suffers from the fact that pendulum weight combined with the undercarriage system unnecessarily adds weight, structure and complexity to the aircraft.

SUMMARY OF THE INVENTION

A remotely controlled aircraft has a motor controlled by a remotely located control unit having a flight string releasibly coupled at the aircraft. The aircraft receives a signal activating the remote control motor. The flight string is released at the aircraft and the flight direction of the aircraft is controlled by the remote control motor based on the received signal.

DETAILED DESCRIPTION

In accordance with an embodiment of the present invention, a remote control (RC) motor disposed within the remotely controlled aircraft performs a number of functions including releasing of the flight string, controlling the flight direction of the aircraft and controlling the shape of the aircraft wing. Note that term "motor" is used herein to include any type of machine or engine that produces or imparts motion. The motor can be, for example, a magnetic actuator or a battery-powered motor. The motor can include an appropriate gear assembly to adjust the speed or torque between the motor and its control arm.

Although embodiments of the present invention are discussed primarily in reference to a glider, embodiments of the present invention can be implemented on other types of remotely controlled aircraft, such as a sailplane, airplane or dirigible. An airplane could be launched, for example, as a conventional kite and then use a motor to at least partially extend its flight time.

Figure 1:
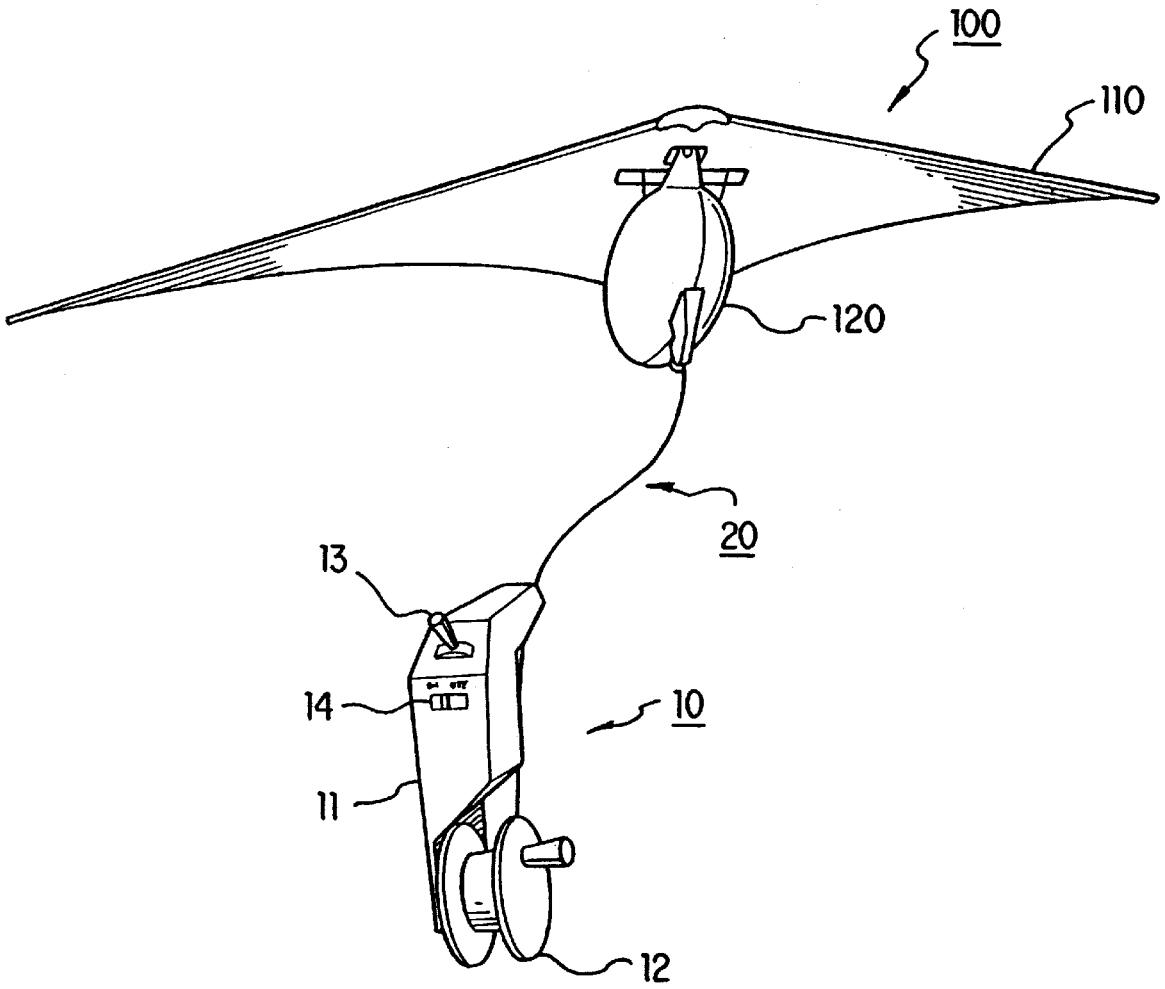
FIG. 1 illustrates a remotely controlled aircraft, according to an embodiment of the present invention.
Figure 2:
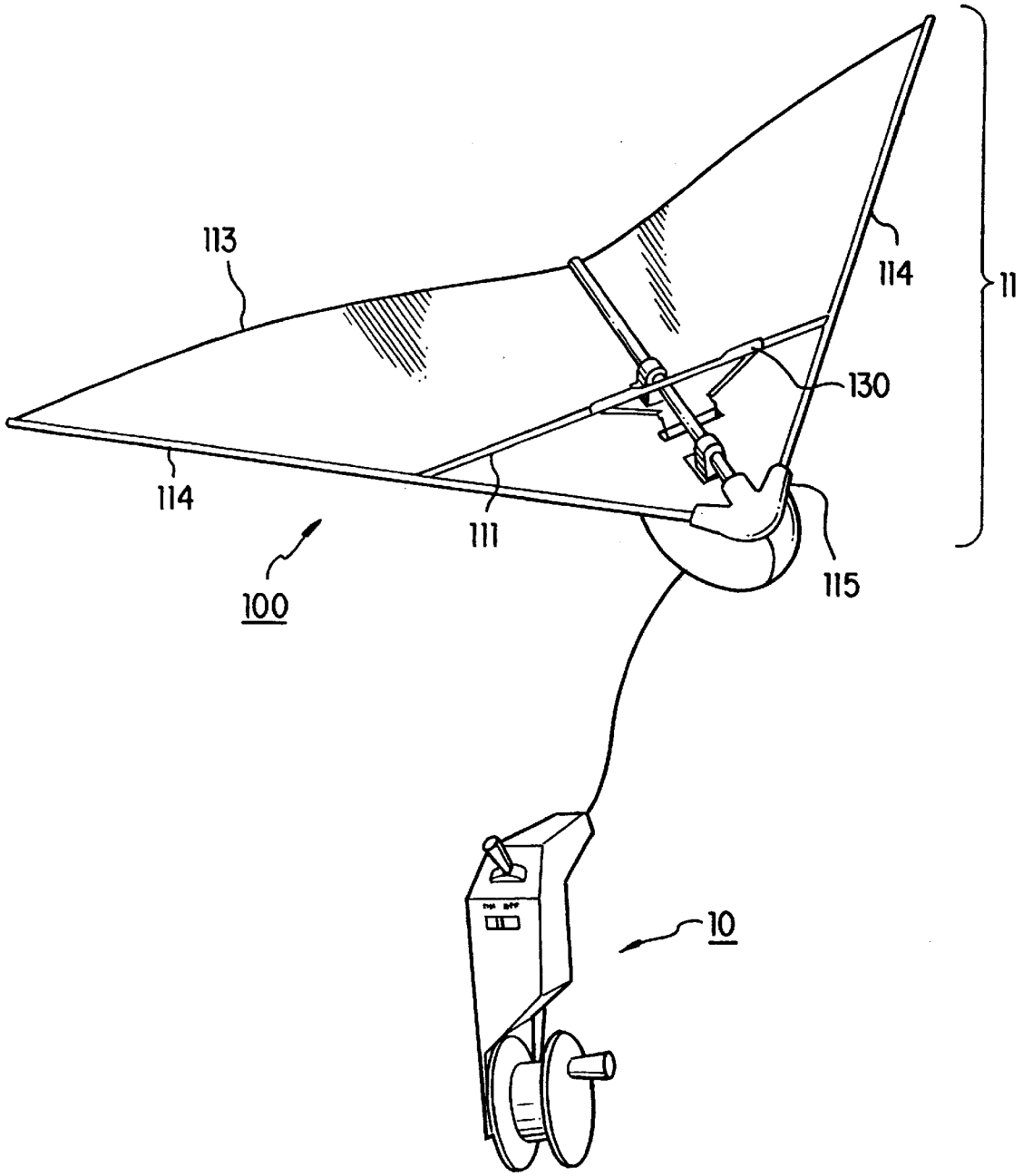
FIG. 2 illustrates a top view of the remotely controlled aircraft shown in FIG. 1 with its associated control unit.

FIG. 1 illustrates a remotely controlled aircraft, according to an embodiment of the present invention. Remotely controlled aircraft 100 includes wing assembly 110 and carriage 120. Carriage 120 of remotely controlled aircraft 100 is connected to control unit 10 by flight string 20. FIG. 2 illustrates a top view of remotely controlled aircraft with its associated control unit shown in FIG. 1.

Control unit 10 includes housing assembly 11, string reel 12, directional controller 13, on/off switch 14 and a remote control transmitter 15 (not shown in FIGS. 1 and 2). Housing assembly 11 houses string reel 12, directional controller 13, on/off switch 14 and remote control transmitter 15.

A user can hold control unit 10 to launch remotely controlled aircraft 100 airborne using the flight string 20 in a manner typical for launching conventional kites. Once the remotely controlled aircraft 100 is airborne to a sufficient altitude, the user can then operate directional controller 13 to activate remote control transmitter 14 to release flight string 20 from carriage 120 of remotely controlled aircraft 100. Note that the point at which flight string 20 is released is at carriage 120. By activating directional controller 13, a signal is sent via remote control transmitter 15 to an RC motor within carriage 120 as discussed more fully below.

Once flight string 20 has been released from remotely controlled aircraft 100, the user can then retrieve and store flight string 20 at a point on the ground. For example, a user can wind flight string 20 using string reel 12 of control unit 10 while also controlling the flight direction of remotely controlled aircraft 100 using directional controller 13. String reel 12 can be a reel manually turned or automatically turned.

Directional controller 13 can be any type of directional controller appropriate for the remote control motor (not shown in FIGS. 1 and 2) within carriage 120. In the embodiment shown in FIGS. 1 and 2, directional controller 13 is a three position joystick indicating a center static position, a rightward position, and a leftward position. In other embodiments, directional controller 13 is a joystick can having additional positions to activate, for example, additional RC channels associated with the RC motor and/or additional RC motors. In other embodiments, directional controller 13 is a set of buttons, such as a left activating button and a right activating button.

Upon activating directional controller 13, RC transmitter 15 sends a signal to remotely controlled aircraft 100 to control its flight direction as discussed more fully below. On/off switch 14 can be used to turn the remote control transmitter 15 off and on for operation.

As shown in FIG. 2 where a top view of remotely controlled aircraft 100 is shown, wing assembly 110 can include cross member 111, center member 112, wing membrane 113, exterior member 114, and nose member 115. Although the various members 111, 112, 114 and 115 provide wing membrane 113 sufficient rigidity for aerodynamic purposes, other configurations using fewer or more support members are possible. For example, a more rigid wing membrane can be selected so that some support members, such as the exterior members may not be necessary.

Figure 3:
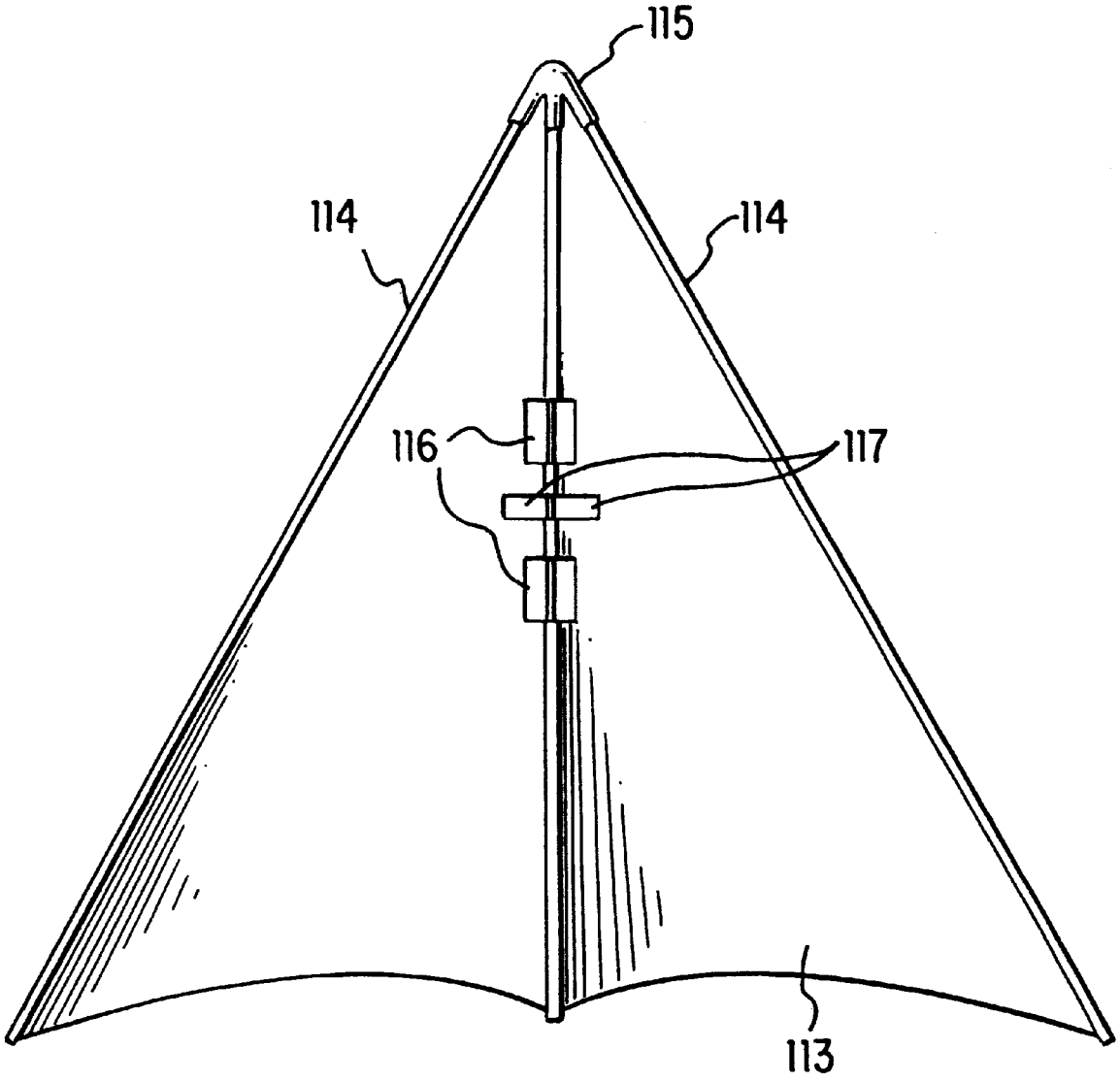
FIG. 3 illustrates a configuration of the wing membrane of the remotely controlled aircraft shown in FIGS. 1 and 2.

FIG. 3 illustrates a configuration of the wing membrane of the remotely controlled aircraft shown in FIGS. 1 and 2. Note that in the embodiment illustrated in FIG. 3, two sets of two apertures in wing membrane 113 are shown: center apertures 116 and off-center apertures 117. Center apertures 116 allow carriage 120 to connect to center member 112. Off-center apertures 117 allow shock-absorbing member 130 to connect to cross member 111 as discussed more fully below. The connection of carriage 120 to cross member 111 and center member 112 through wing membrane 113 can also be viewed in the top view of remotely controlled aircraft 100 shown in FIG. 2. Although the specific shapes of center apertures 116 and off-center apertures 117 are shown in FIG. 3 as rectangles, other shapes are possible which allow access for the relevant aircraft components to cross member 111.

Figure 4:
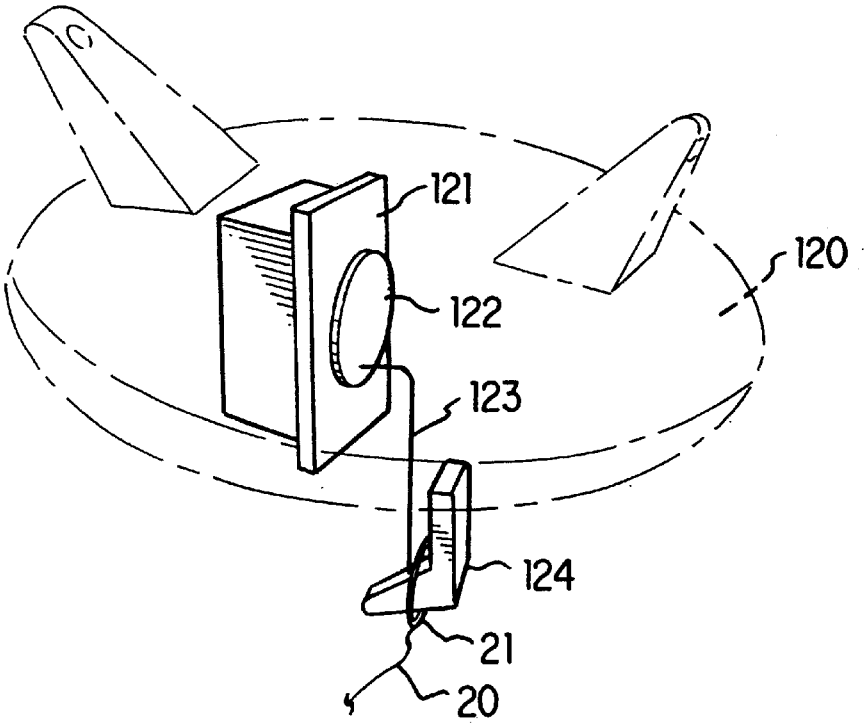
FIG. 4 illustrates a carriage and a releasible flight string of the remotely controlled aircraft shown in FIGS. 1 and 2.

FIG. 4 illustrates a carriage and a releasible flight string of the remotely controlled aircraft shown in FIGS. 1 and 2. As shown in FIG. 4, carriage 120 includes RC motor 121 which can include control arm 122. Control arm 122 is connected to release pin 123. Capture arm 124 is connected to carriage 120 at one end and is open at the other end. For example, capture arm 124 can be integrally formed with carriage 120.

Capture arm 124 can include a release pin aperture located near the open end of capture arm 124 into which the release pin 123 can slidably engage. The release pin aperture can be a hole which passes entirely or only partially through capture arm 124. Flight string 20 can include loop 21 which can fit over capture arm 124 so that loop 21 can be disposed between release pin receptacle and the end of capture arm 124 that connects to carriage 120. In this manner, flight string 20 can be connected to carriage 120 and, of course, remotely controlled aircraft 100.

Capture arm 124 can have, for example, an L shape and allow loop 21 of flight string 20 to fit over the open end of capture arm 124. Capture arm 124 can absorb shock to carriage 120 when remotely controlled aircraft 100 lands. In other words, when remotely controlled aircraft 100 lands, carriage 120 and possibly capture arm 124 are the points at which remotely controlled aircraft 100 impacts the ground. The shock absorbing qualities of capture arm 124 are possible where capture arm 124 can vertically flex upon impact. Although capture arm 124 is shown in FIG. 4 with an L shape, other shapes are possible, such as a C shape or a straight-angled shape.

Figure 5:
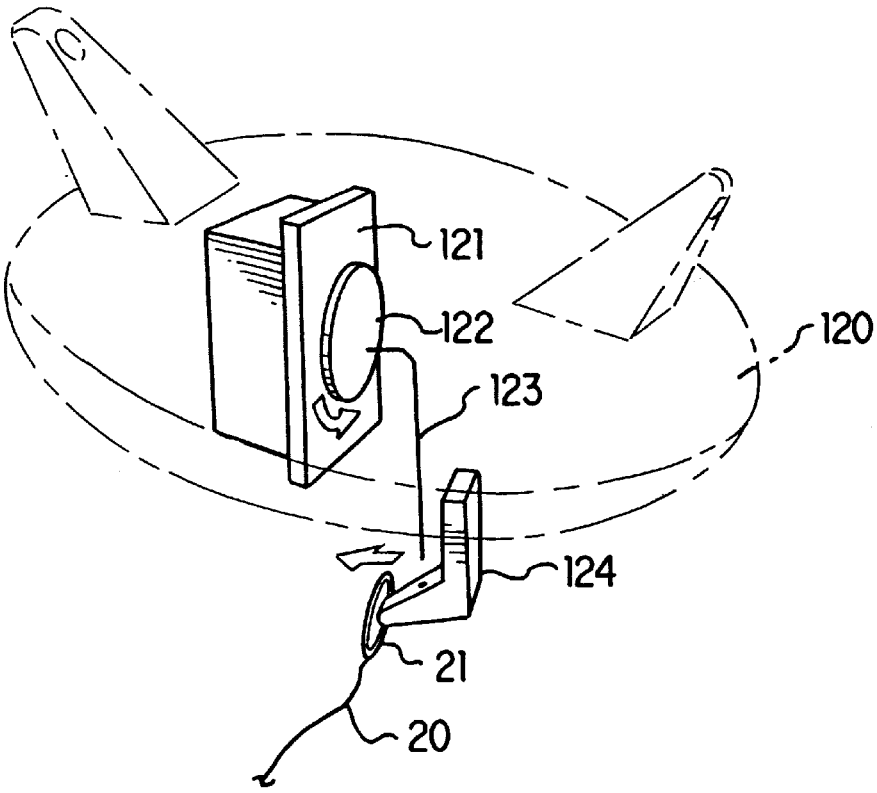
FIG. 5 illustrates the flight string being released from the carriage shown in FIG. 4.

FIG. 5 illustrates the flight string being released from the carriage shown in FIG. 4. When RC motor 121 receives a signal sent by RC transmitter 15 of control unit 10, control arm 122 rotates thereby bringing release pin 123 upward in a direction away from capture arm 124. By moving release pin 123 away capture arm 124, release pin 123 is moved out of the release pin receptacle. Once release pin 123 has been moved out of the release pin receptacle of capture arm 124, flight string 20 and its loop 21 slide or move out of the capture arm 123, thereby disconnecting flight string 20 from carriage 121 and, consequently, remotely controlled aircraft 100.

Note that control arm 122 of RC motor 121 can rotate in either direction to release thereby pin 123 from the release pin receptacle of capture arm 124. This occurs because release pin 123 can be connected to control arm 122 of RC motor 121 at the lower most part of control arm 122. When the user activates directional controller 13 of control unit 10, a signal is sent to RC motor 121 upon which control 122 rotates either clockwise or counter clockwise to move release pin 123 away from capture arm 124.

The mechanism for remotely releasing the flight string from the aircraft, an example of which is shown in FIGS. 4 and 5, can be combined with mechanisms for remotely controlling the flight direction of the aircraft after release of the flight string. In some embodiments, the remote release of the flight string and the remote control of the flight direction can be accomplished with the same RC motor. In one embodiment, for example, a single control rod (not shown) can connect the control arm of the RC motor shown in FIGS. 4 and 5 to a rudder (not shown) located, for example, at the rear of the aircraft carriage. In this embodiment, upon receiving a signal activating the control arm of the RC motor, the control arm rotates thereby releasing the flight string from the capture arm and thereby controlling the rudder direction. Other embodiments discussed below control the flight direction of the aircraft without the use of a rudder.

Figure 8:
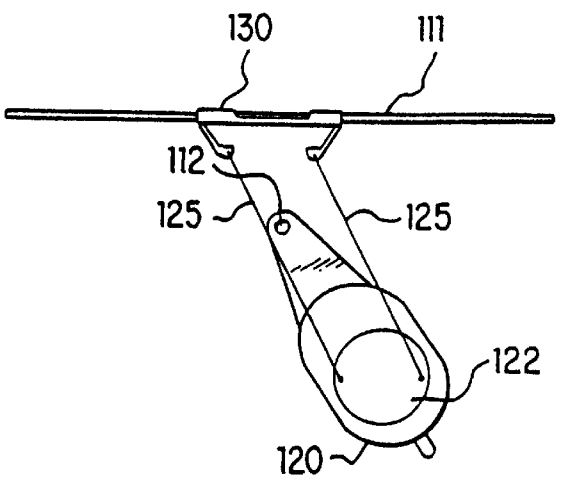
FIGS. 6 through 8 illustrate a front view of the remote control motor coupled to the cross member of the wing assembly shown in FIGS. 1 and 2.
Figure 7:
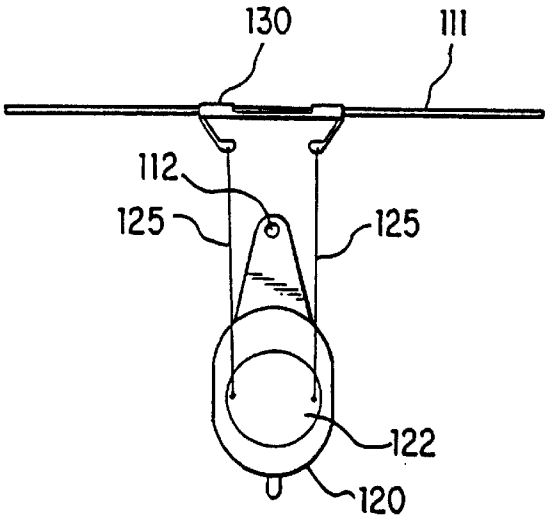
Figure 6:
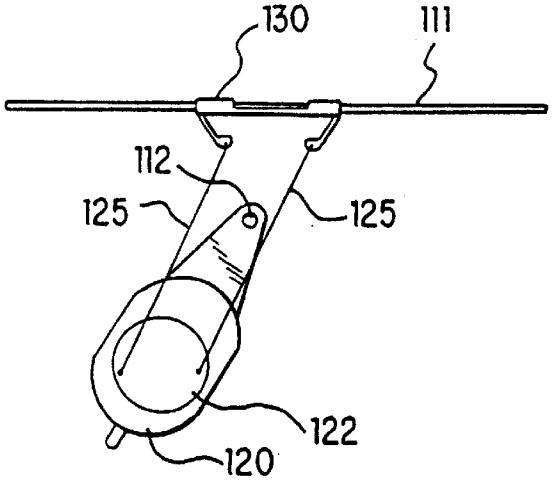

FIGS. 6 through 8 illustrate a front view of the RC motor coupled to the cross member of the wing assembly shown in FIGS. 1 and 2. As shown in FIGS. 6 through 8, RC motor 121 includes control arm 122 which is connected to control rods 125. Control rods 125 are connected to shock absorbing member 130 which is connected to cross member 111 of wing assembly 110 (not shown in FIGS. 6 through 8, but see FIG. 2). Carriage 120 is rotatably connected to center member 112.

FIG. 7 illustrates the position of control arm 122 and RC motor 121 when centered. RC motor 121 and control arm 122 are centered when remotely controlled aircraft 100 is in the kite configuration before flight string 20 has been released and when the remotely controlled aircraft 100 has a straight flight direction after the kite string 20 has been released.

FIG. 6 shows a position of RC motor 121 and control rods 125 when the RC motor 121 has been activated by receiving a signal from RC transmitter 15 of control unit 10 shown above in FIG. 1 and 2. Upon receiving the signal from remote control transmitter 15, control arm 122 rotates, thereby causing carriage 120 to pivot around center member 112 due to the rigidity of control rods 125 which are connected to control arm 122 and shock absorbing member 130. By rotating the position of carriage 120 about center member 112, the flight direction of remotely controlled aircraft 100 correspondingly can change.

As shown in FIG. 6 where the front of remotely controlled aircraft 100 is coming out of the page, by rotating the position of carriage 120 with respect to center member 112, the direction of remotely controlled aircraft 100 changes to the right from the perspective on the aircraft facing forward. In other words, by changing the center of gravity of carriage 120 and, correspondingly remotely controlled aircraft 100, to the right, the flight direction of remotely controlled aircraft 100 would also change to the right.

Similar to FIG. 6 where the position of carriage 120 has been rotated with respect to center member 112, FIG. 8 also illustrates the position of carriage 120 being rotated in the opposite direction with respect to center member 112. By rotating the position of carriage 120 with respect to center member 112 to the left, the direction of remotely controlled aircraft 100 changes to the left from the perspective on the aircraft facing forward. In other words, by changing the center of gravity of carriage 120 and, correspondingly remotely controlled aircraft 100, to the left, the flight direction of remotely controlled aircraft 100 would also change to the left.

Figure 9:
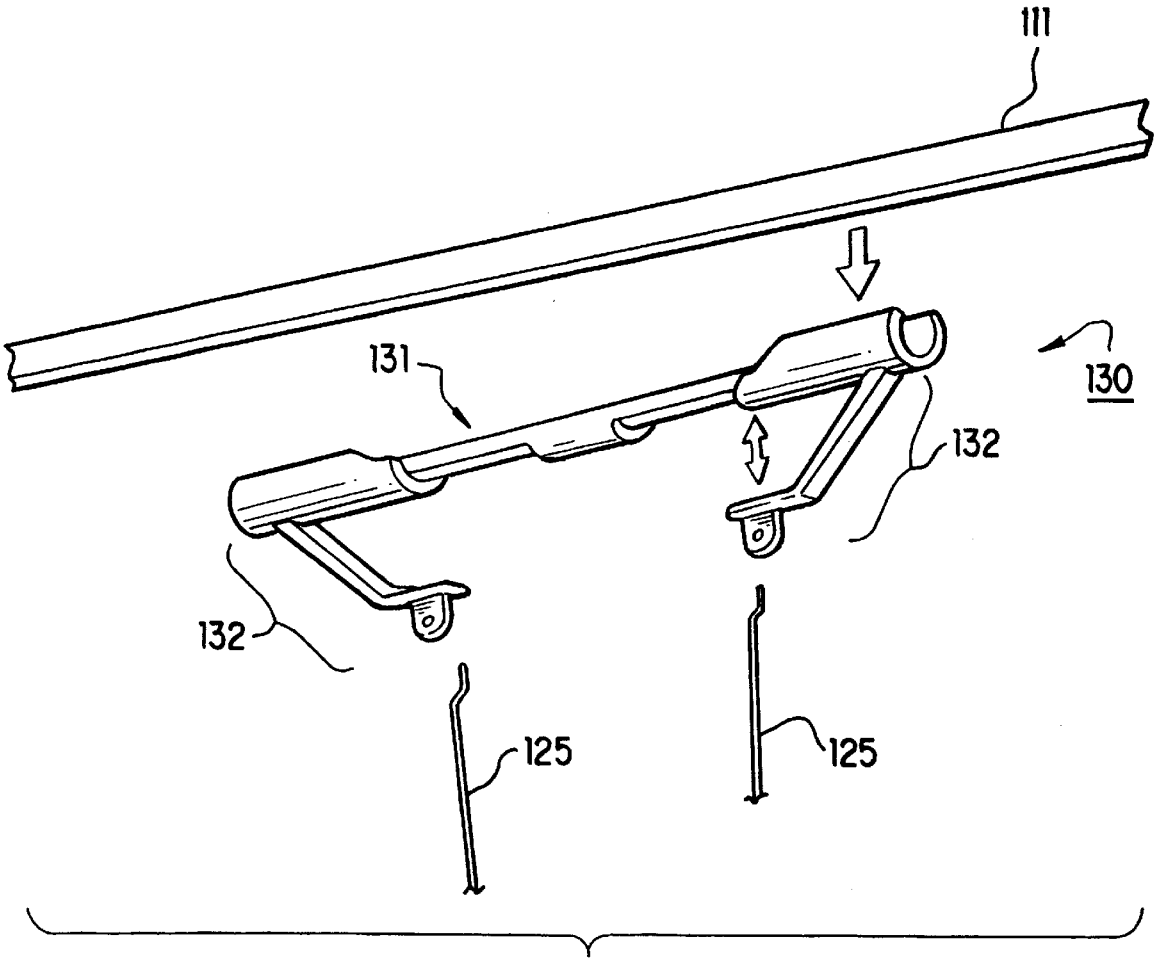
FIG. 9 illustrates a shock absorbing member of the remote control aircraft shown in FIGS. 1 and 2.

FIG. 9 illustrates a shock absorbing member of the remotely controlled aircraft shown in FIGS. 1 and 2. Shock absorbing member 130 includes main member 131 and arms 132. Main member 131 can be, for example, integrally formed with arms 132. Main member 131 of shock absorbing member 130 can be connected to cross member 111. For example, as shown in FIG. 9, main member 131 of shock absorbing member 130 can snugly fit or snap onto cross member 111.

Each arm 132 of shock absorbing member 130 can include a portion to be connected to one control rod 125. Both arms 132 can be flexible to allow shock to be absorbed between RC motor 121 and center member 111 thereby preventing the gears of RC motor 121 from being stripped upon carriage 120 impacting the ground during landing. For example, when remotely controlled aircraft 100 lands on the ground, carriage 120 will likely impact the ground at an angle thereby pushing carriage 120 further away from the centered position. Unless the coupling between control arm 122 and cross member 111 is flexible, the gears of RC motor 121 would be stripped upon impact; shock absorbing member 130 absorbs the shock of impact thereby preventing the gears of RC motor 121 from being stripped.

Although a particular configuration for shock absorbing member 130 is shown in FIG. 9, many other configurations are possible. For example, the particular open L-shaped configuration of arms 132 is not required; rather, arms 132 could have different types of L shapes or could be made of a solid material which sufficiently allowed shock to be absorbed. Similarly, main member 131 of shock absorbing member 130 can have different configurations as well. For example, shock absorbing member 130 could be connected to cross member 111 by integrally forming cross member 111 with shock absorbing member 130.

Figure 12:
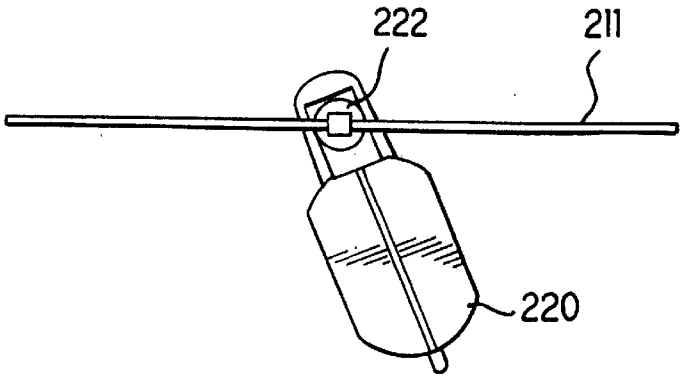
FIGS. 10 through 12 illustrate a front view of the remote control motor coupled to a cross member of a wing assembly, according to an alternative embodiment of the present invention.
Figure 11:
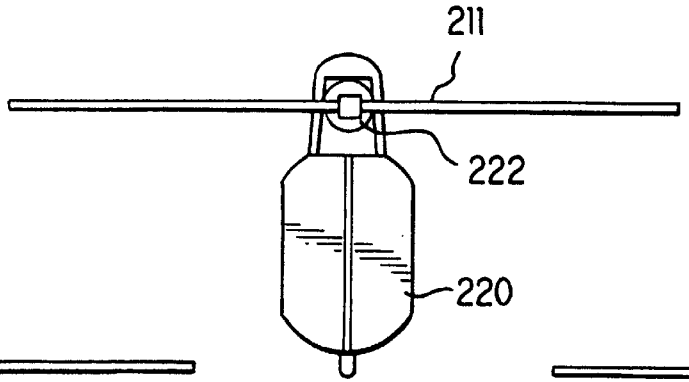
Figure 10:
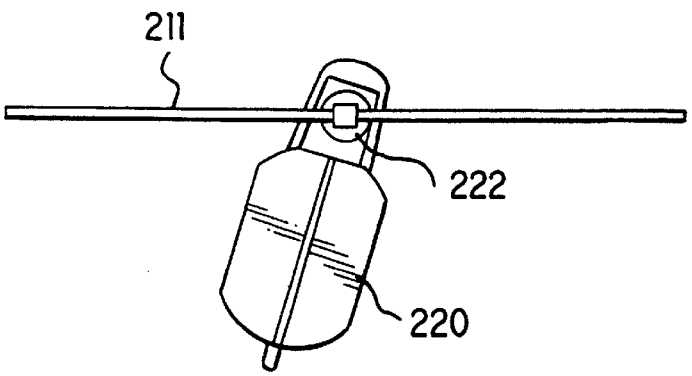

FIGS. 10 through 12 illustrate a front view of the RC motor coupled to a cross member of a wing assembly, according to an alternative embodiment of the present invention. FIGS. 10 through 12 illustrate an alternative manner by which a carriage can be coupled to a cross member of a wing assembly and rotated with respect to the cross member thereby changing the flight direction of the remotely controlled aircraft. As shown in FIGS. 10 through 12, the control arm 222 can be connected directly to cross-member 211 without the use of control rods.

FIG. 11 illustrates when carriage 220 is in a center position. Carriage 220 is centered when the remotely controlled aircraft is in the kite configuration before the flight string has been released and when the remotely controlled aircraft has a straight flight direction after the kite string has been released.

When the RC motor is activated, thereby causing control arm 222 to rotate, carriage 220 can be rotated with respect to cross member 211. As shown in FIG. 10 where the front of the remotely controlled aircraft is coming out of the page, by rotating the position of carriage 220 with respect to cross member 211, the flight direction of the remotely controlled aircraft changes to the right from the perspective on the aircraft facing forward. As shown in FIG. 12 where the front of the remotely controlled aircraft is coming out of the page, by rotating the position of carriage 220 with respect of cross member 211, the flight direction of the remotely controlled aircraft changes to the left from the perspective on the aircraft facing forward.

Figure 15:
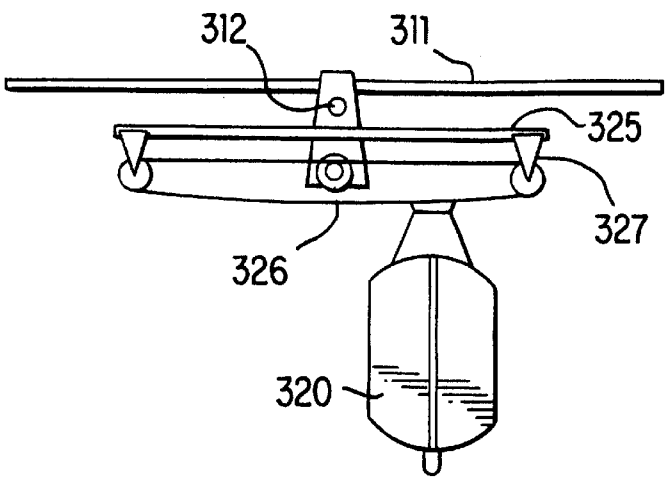
FIGS. 13 through 15 illustrate a front view of a translating assembly coupled to a cross member of a remotely controlled aircraft, according to an alternative embodiment of the present invention.
Figure 14:
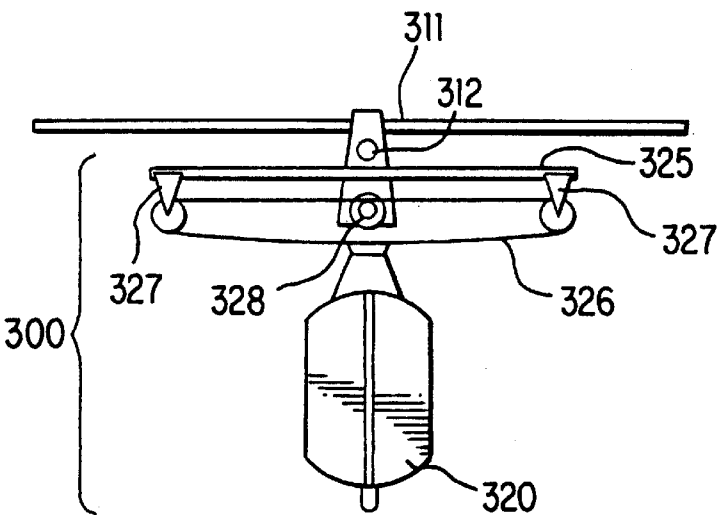
Figure 13:
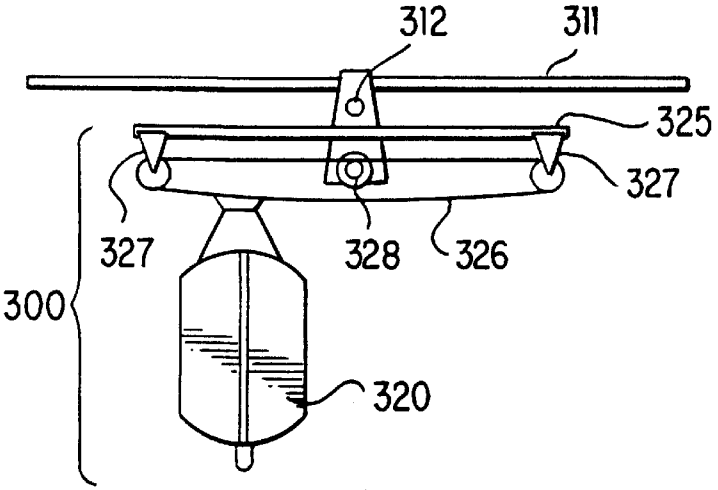

FIGS. 13 through 15 illustrate a front view of a translating assembly coupled to a cross member of a remotely controlled aircraft, according to an alternative embodiment of the present invention. FIGS. 13 through 15 show the aircraft where the front of the remotely controlled aircraft is coming out of the page.

Translating assembly 300 is connected to cross member 311 and center member 312; translating assembly 300 includes mount member 325, belt 326, pulleys 327, carriage 320 and control arm 328 of an RC motor (not shown). Carriage 320 is connected to a section of belt 326 opposite the section of belt 326 tangentially engaged with control arm 328. In this embodiment, mount member 325 is substantially parallel to cross member 311 of the aircraft.

FIG. 14 illustrates when carriage 320 is in a center position. Carriage 320 is centered when the remotely controlled aircraft is in the kite configuration before the flight string has been released and when the remotely controlled aircraft has a straight flight direction after the kite string has been released.

When the RC motor is activated thereby causing control arm 322 to rotate and belt 326 to move around pulleys 327, carriage 320 laterally translates along with belt 326 so that carriage 320 is located off center with respect to center member 312 of the aircraft from the perspective on the aircraft facing forward. As shown in FIG. 13, when control arm 322 rotates clockwise, carriage 320 is located to the right with respect to center member 312 and the flight direction of the remotely controlled aircraft changes to the right. As shown in FIG. 15, when control arm 322 rotates clockwise, the flight direction of the remotely controlled aircraft changes to the left.

Figure 18:
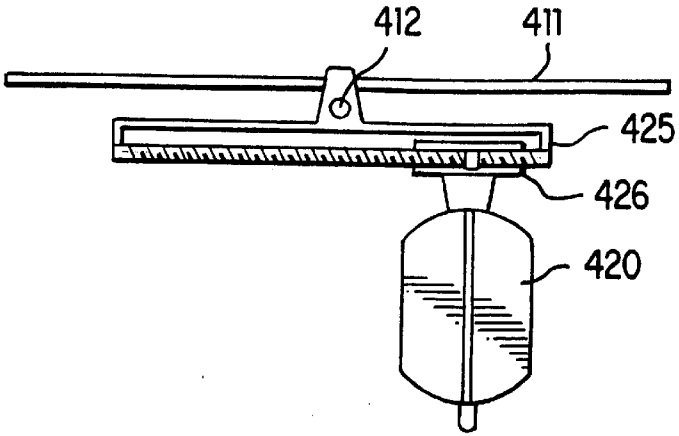
FIGS. 16 through 18 illustrate a front view of a translating assembly coupled to a cross member of a remotely controlled aircraft, according to an alternative embodiment of the present invention.
Figure 17:
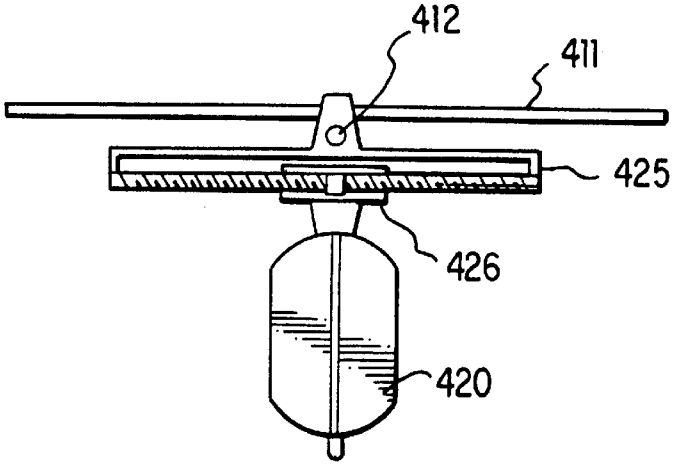
Figure 16:
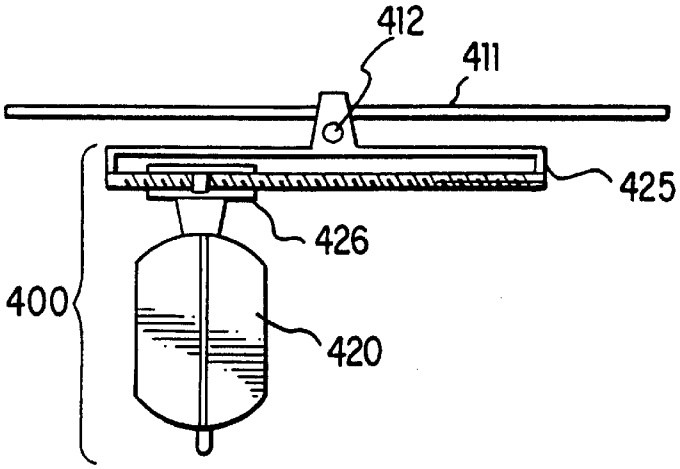

FIGS. 16 through 18 illustrate a front view of a translating assembly coupled to a cross member of a remotely controlled aircraft, according to an alternative embodiment of the present invention. FIGS. 16 through 18 show the aircraft where the front of the remotely controlled aircraft is coming out of the page.

Translating assembly 400 is connected to cross member 411 and center member 412; translating assembly 400 includes mount member 425, carriage 420 and worm gear 426 of an RC motor (not shown). In this embodiment, mount member 425 is substantially parallel to cross member 411 of the aircraft.

FIG. 17 illustrates when carriage 420 is in a center position. Carriage 420 is centered when the remotely controlled aircraft is in the kite configuration before the flight string has been released and when the remotely controlled aircraft has a straight flight direction after the kite string has been released.

When the RC motor is activated thereby causing worm gear 426 to rotate about the threaded portion of mount section 425, carriage 420 laterally translates along mount section 425 so that carriage 420 is located off center with respect to center member 412 of the aircraft from the perspective on the aircraft facing forward. As shown in FIG. 16, when worm gear 426 rotates in one direction, carriage 420 is located to the right with respect to center member 412 and the flight direction of the remotely controlled aircraft changes to the right. As shown in FIG. 18, when worm gear 426 rotates in the direction opposite of that shown in FIG. 16, the flight direction of the remotely controlled aircraft changes to the left.

Figure 19:
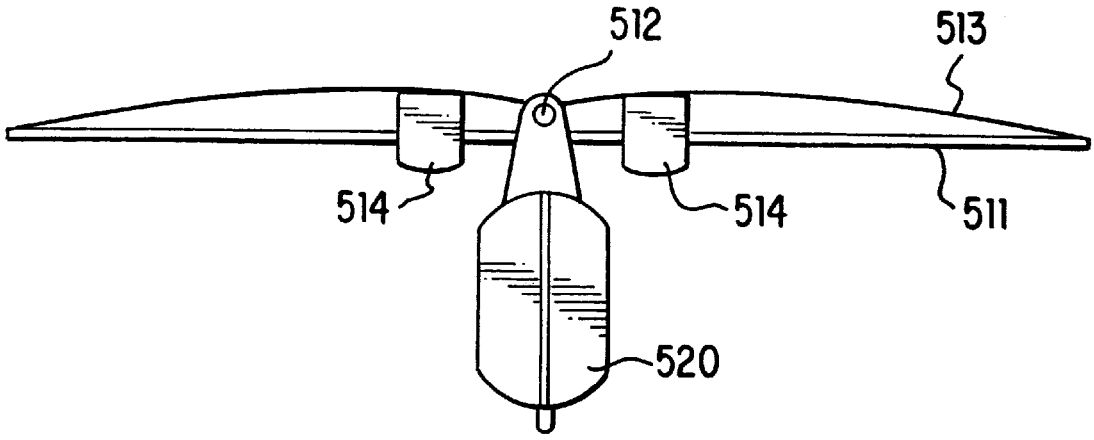
FIG. 19 illustrates a front view of a remotely controlled aircraft, according to another embodiment of the present invention.
Figure 20:
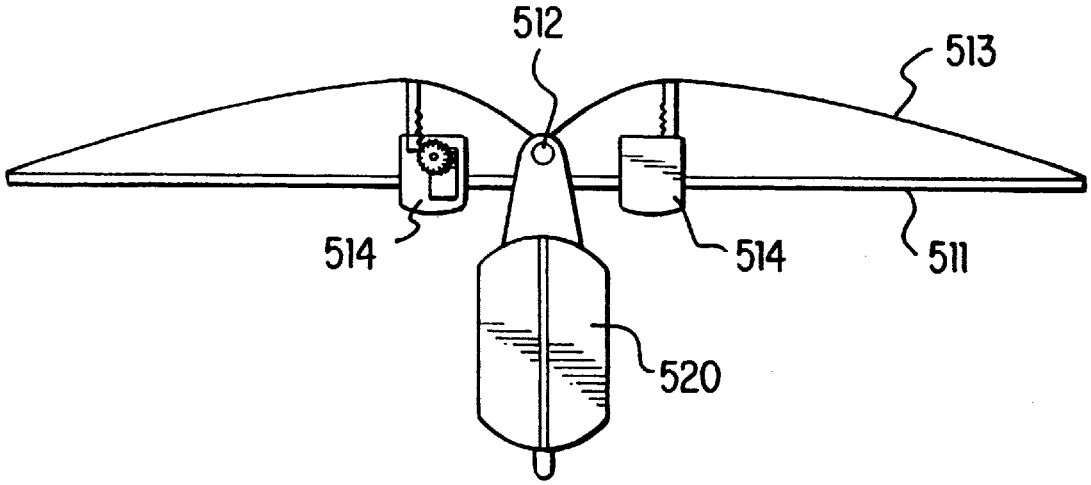
FIG. 20 illustrates a front view of the remotely controlled aircraft shown in FIG. 19 with the wing membrane having a modified shape.

FIGS. 19 and 20 illustrates a front view of a remotely controlled aircraft, according to an embodiment of the present invention. FIGS. 19 and 20 show the aircraft where the front of the remotely controlled aircraft is coming out of the page.

Carriage 520 is connected to cross member 511 and center member 512. In this embodiment, center member 512 is below cross member 511; both center member 512 and cross member 511 are below wing membrane 513. Two actuators 514 are connected to cross member 511 and interact with wing membrane 513.

Each actuator 514, for example, can include an RC motor connected to a telescoping rod in a rack-and-pinion configuration. The exterior end of the telescoping rod is arranged in contact with wing membrane 513. In one embodiment, the two actuators 514 are controlled together so that both extend or retract their respective telescoping rods substantially in parallel. In this embodiment, actuators 514 modify the shape of wing membrane 513 to change remotely the aerodynamic characteristics of the aircraft thereby changing its lift and drag characteristics without changing the flight direction.

In another embodiment, the two actuators 514 are controlled together so that both extend or retract their respective telescoping rods substantially in opposition. In other words, when one telescoping rod extends, the other telescoping rod retracts to the same extent. In this embodiment, actuators 514 modify the shape of wing membrane 513 to change remotely the flight direction of the aircraft.

In another embodiment, the actuators are independently controlled by separate RC channels so that their respective telescoping rods can extend or retract independently. Consequently, the actuators can modify the shape of the wing membrane to change remotely the aerodynamic characteristics of the aircraft thereby changing its lift and drag characteristics, and/or changing its flight direction.

FIG. 20 illustrates a front view of the remotely controlled aircraft shown in FIG. 19 with the wing membrane having a modified shape. When a user on the ground activates a directional controller of a control unit, a signal is sent from the RC transmitter of the control unit to actuators 514. As shown in FIG. 20, when a signal is received by actuators 514, the respective telescoping rods of actuators 514 are telescoped outward thereby modifying the shape of wing membrane 513. By modifying the shape of wing membrane 513, the aircraft characteristics can be controlled. For example, by modifying the shape of wing membrane 513 from that shown in FIG. 19 and that shown in FIG. 20, the aerodynamic characteristics of the aircraft, i.e., the lift and drag characteristics, can be remotely controlled.

Figure 21:
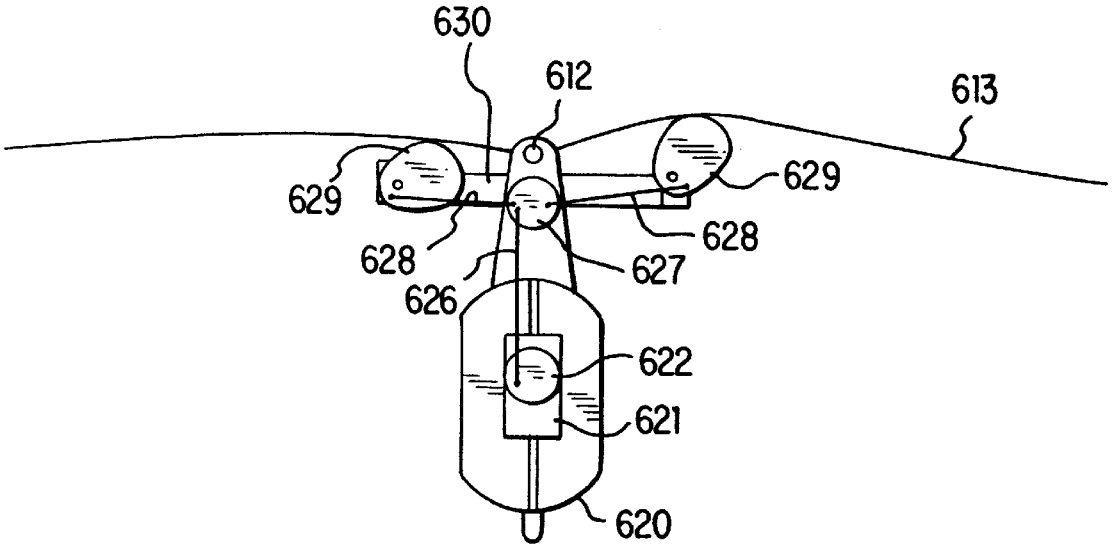
FIGS. 21 and 22 illustrate a front view of a remotely controlled aircraft with a wing membrane having a modified shape, according to another embodiment of the present invention.
Figure 22:
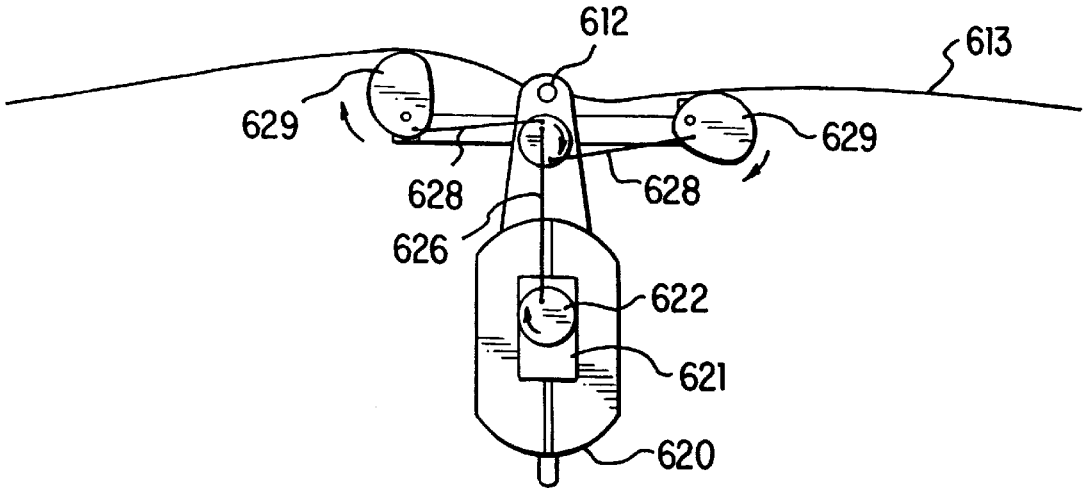

FIGS. 21 and 22 illustrate a front view of a remotely controlled aircraft with a wing membrane having a modified shape, according to another embodiment of the present invention. FIGS. 21 and 22 show the aircraft where the front of the remotely controlled aircraft is coming out of the page.

Carriage 620 is connected to center member 612 and includes a single actuator. The actuator includes RC motor 621, control arm 622, main rod 626, second control arm 627, cam rods 628, cams 628 and cam post 630. Main rod 626 is connected between control arm 622 and second control arm 627. Each cam rod 628 connects one cam 628 to second control arm 628. Each cam 628 is pivotally mounted at opposite ends of cam post 639. Cams 630 contact wing membrane 613.

As RC motor 621 receives a signal from a RC transmitter (not shown) in a control unit (not shown), RC motor 621 correspondingly turns control arm 622 which turns second control arm 627 due to main rod 626. As second control arm 627 turns, each cam rod 628 causes its respective cam 628 to rotate about its own pivot point on cam post 630. By rotating about their own pivot points on cam post 630, cams 630 modify the shape of wing membrane 613 to remotely change the flight direction of the aircraft.

In another embodiment, the cams are pivotally mounted on the cam post so that they rotate in a mirrored fashion. In other words, the cams mounted on the cam post so that as change the shape to the wing membrane symmetrically; as one cam rotates and changes the wing membrane shape on one side of the center member, the other cam rotates and changes the wing membrane shape on the other side of the center member so the same extent. By arranging the cams to allow symmetrical change of the wing membrane, the aerodynamic characteristics of the aircraft, i.e., the lift and drag characteristics, can be remotely controlled.

Figure 23:
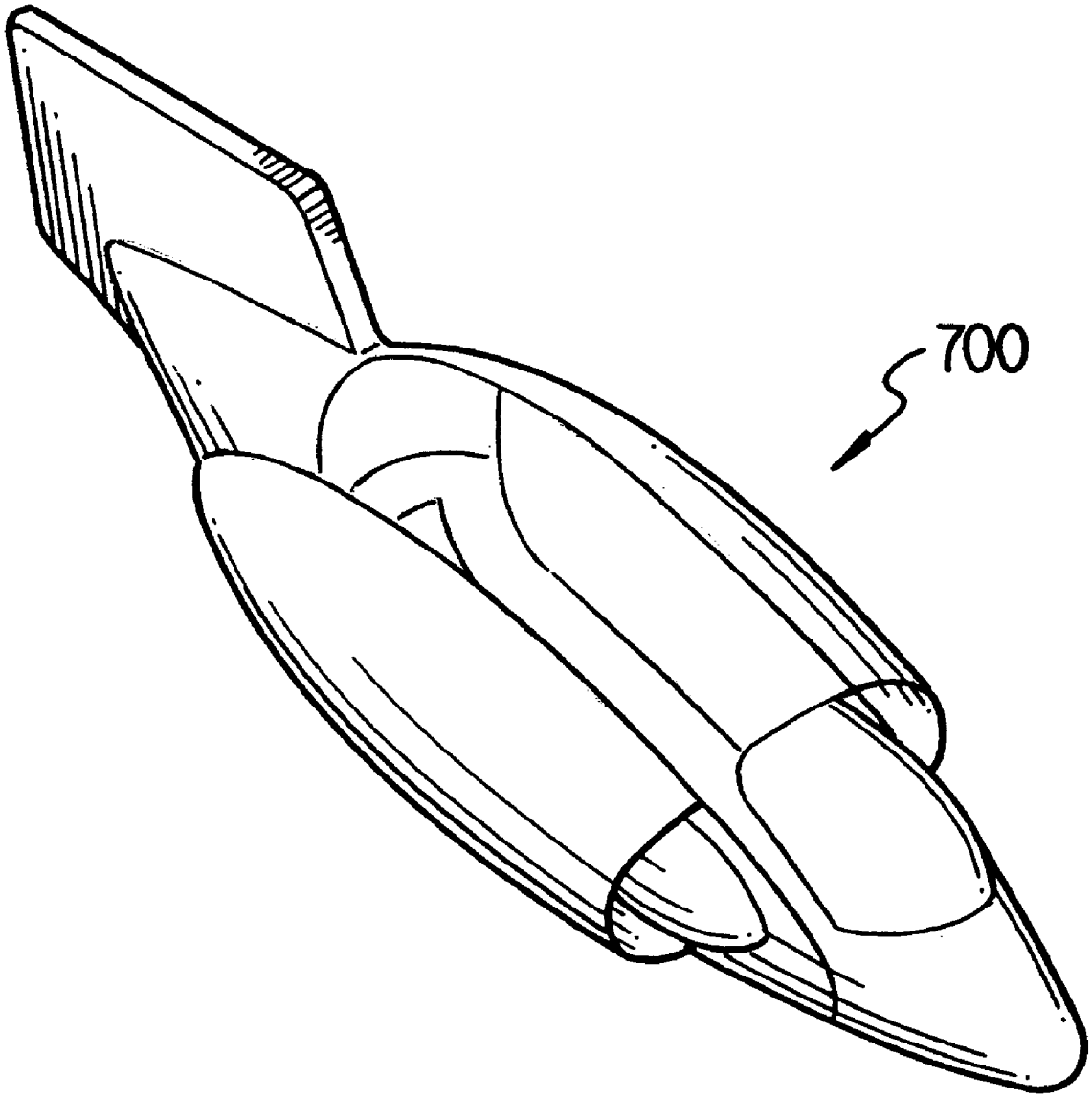
FIG. 23 illustrates an attachment body for the carriage of a remotely controlled aircraft, according to another embodiment of the present invention.

FIG. 23 illustrates an attachment body for the carriage of a remotely controlled aircraft, according to an embodiment of the present invention. Attachment body 700 can have any type of appropriate shape, typically differing from the carriage. Attachment body 700 can be attached to the carriage by fitting snugly or snapping onto the carriage thereby allowing different attachment bodies to be interchanged to vary the appearance of the remotely controlled aircraft. As shown in FIG. 23, attachment body 700 has a shape like a rocket ship. Alternatively, attachment body 700 can be shaped like a plane, blimp, etc.

It should, of course, be understood that while the present invention has been described in reference to particular configurations, other configurations should be apparent to those of ordinary skill in the art. For example, an embodiment where the flight direction of the aircraft is remotely controlled can be combined with an embodiment where the lift and drag characteristics of the aircraft are remotely controlled. More specifically, for example, the configuration of the carriage rotating about the center member to remotely control the aircraft can be combined with an actuator arrangement where the lift and drag characteristics of the aircraft can be remotely controlled. In such a configuration, the remote control of the flight direction can be obtained with one RC channel and the remote control of the aircraft's lift and drag characteristics can be obtained with another RC channel where both RC channels controlled within the same control unit and housing assembly.

What is claimed is:

1. A remotely controlled aircraft, comprising:

a wing assembly;

a carriage coupled to said wing assembly; and a remote control motor coupled to said wing assembly, said remote control motor to be releasibly coupled to a flight string, said remote control motor controlling flight direction of said remotely controlled aircraft and controlling release of the flight string at the remotely controlled aircraft.

2. The remotely controlled aircraft of claim 1, further comprising:

an attachment body having a shape different from said carriage, said attachment body fittingly engagable over said carriage.

3. The remotely controlled aircraft of claim 1, wherein said remote control motor is controlled by a remote control transmitter disposed within a housing assembly of a control unit.

4. The remotely controlled aircraft of claim 1, wherein:

said remote control motor is controlled by a remote control transmitter disposed within a housing assembly of a control unit, the housing assembly including a string reel connected to the flight string.

5. The remotely controlled aircraft of claim 1, wherein the flight string has a first end and a second end, the first end of the flight string being releasibly coupled to the aircraft, the second end of the flight string being disposed at a terrestrial location.

6. The remotely controlled aircraft of claim 1, wherein:

the aircraft has a kite configuration while the flight string is coupled to the aircraft, and the aircraft has a glider configuration after the flight string has been released at the aircraft.

7. The remotely controlled aircraft of claim 1, wherein:

the aircraft is launchable as a kite and flyable as a kite while the flight string is coupled to the aircraft, and the aircraft is flyable as a glider after the flight string has been released at the aircraft.

8. A method for remotely controlling an aircraft having a remote control motor controlled by a remotely located control unit having a flight string releasibly coupled at the aircraft, comprising:

(a) receiving a signal at the aircraft activating the remote control motor;

(b) releasing the flight string at the aircraft based on the signal received in said receiving step (a), the flight string having a first end and a second end, the first end of the flight string being releasibly coupled at the aircraft, the second end of the flight string being disposed at a terrestrial location; and (c) controlling flight direction of the aircraft based on the signal received in said receiving step (a).

9. The method of claim 8, further comprising:

(d) launching the aircraft to a sufficient altitude using the flight string.

10. The method of claim 8, further comprising:

(d) winding the flight string at the control unit when the flight string is released from the remotely controlled aircraft in said receiving step (b).

11. The method of claim 8, further comprising:

(d) winding the flight string at the control unit, after the flight string is released at the remotely controlled aircraft in said releasing step (b); and (e) sending the signal to the aircraft to further control flight direction of the aircraft while concurrently performing said winding step (c).

12. The method of claim 8, wherein:

the aircraft has a kite configuration while the flight string is coupled to the aircraft, and the aircraft has a glider configuration after the flight string has been released at the aircraft.

13. The method of claim 8, wherein:

the aircraft is launchable as a kite and flyable as a kite while the flight string is coupled to the aircraft, and the aircraft is flyable as a glider after the flight string has been released at the aircraft.

14. In a remotely controlled aircraft, a carriage, said carriage comprising:

a remote control motor having a control arm;

a release pin connected to the control arm of said remote control motor; and a capture arm having a first end connected to the carriage and having a release pin receptacle, the release pin receptacle being slidably engagable with the release pin, the capture arm being engagable with a first end of a flight string being disposed between the first end of the capture arm and the release pin receptacle of the capture arm.

15. The carriage of claim 14, wherein said remote control motor rotates the control arm which removes the release pin from the release pin receptacle of said capture and release the flight string from said capture arm, when said remote control motor receives a signal activating said remote control motor.

16. The carriage of claim 14, wherein the control arm of said remote control motor is connected to a first control rod and a second control rod, the first control rod being and the second control rod being coupled to a cross member of the aircraft.

17. In a remotely controlled aircraft having a cross member and a carriage, said carriage comprising:

a shock absorbing member connected to the cross member of the remotely controlled aircraft;

a remote control motor having a control arm;

a first control rod having a first end and a second end, the first end of the first control rod being connected at a first end to the control arm of said remote control motor, the second end of the first control rod being connected to the shock absorbing member; and a second control rod having a first end and a second end, the first end of the second control rod being connected at a first end to the control arm of said remote control motor, the second end of the second control rod being connected to the shock absorbing member.

18. The carriage of claim 17, wherein a shock absorbing member connects the second end of the first control rod and the second end of the second control rod to the cross member of the aircraft.

19. A method for remotely controlling an aircraft having a remote control motor, a flight string releasibly coupled at the aircraft, comprising:

receiving a remote control signal at the aircraft;

operating the remote control motor to release the flight string at the aircraft based on the received remote control signal; and operating the remote control motor further to control the flight direction of the aircraft based on the received remote control signal.

20. The method of claim 19, wherein:

the aircraft has a kite configuation while the flight string is coupled to the aircraft, and the aircraft has a glider configuration after the flight string has been released at the aircraft.

* * * * *